US007804968B2

(12) United States Patent
Akino

(10) Patent No.: US 7,804,968 B2
(45) Date of Patent: Sep. 28, 2010

(54) CONDENSER MICROPHONE

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 1313 days.

(21) Appl. No.: 11/129,287

(22) Filed: May 16, 2005

(65) Prior Publication Data

US 2005/0259835 A1 Nov. 24, 2005

(30) Foreign Application Priority Data

May 19, 2004 (JP) ..... 2004-148574

(51) Int. Cl.
*H04R 3/00* (2006.01)

(52) U.S. Cl. ..... 381/111; 381/113; 381/91; 381/174

(58) Field of Classification Search ..... 381/111–115, 381/174, 361, 368, 176, 355, 91–92, 122
See application file for complete search history.

(56) References Cited

U.S. PATENT DOCUMENTS

| | | | | |
|---|---|---|---|---|
| 5,122,622 | A * | 6/1992 | Reuss et al. | 174/113 C |
| 6,962,524 | B2 * | 11/2005 | Butterfield et al. | 451/526 |
| 7,382,889 | B2 * | 6/2008 | Akino | 381/113 |
| 7,460,681 | B2 * | 12/2008 | Geschiere et al. | 381/324 |
| 2005/0259835 | A1 * | 11/2005 | Akino | 381/111 |

FOREIGN PATENT DOCUMENTS

| | | |
|---|---|---|
| JP | U S61-205199 | 12/1986 |
| JP | U S62-177189 | 11/1987 |
| JP | H11-341583 | 12/1999 |

OTHER PUBLICATIONS

Radio Frequency Susceptibility of Capacitor Microphones by Jim Brown and David Josephson AES convention in Amsterdam, Mar. 2003.*

* cited by examiner

*Primary Examiner*—Devona E Faulk
*Assistant Examiner*—Disler Paul
(74) *Attorney, Agent, or Firm*—Manabu Kanesaka

(57) ABSTRACT

The occurrence of noise caused by external electromagnetic waves is prevented and a high voltage is prevented in a microphone case, so that the possibility of an electrical shock is eliminated. A condenser microphone, comprising a microphone case (shield case) 10 including a circuit board 11 having a ground circuit 13 and an electronic circuit 12 for a condenser microphone unit MU, and a 3-pin output connector 20 which is mounted on the microphone case 10 and connected to a microphone cable 30 from an external power unit (for example, a phantom power source), the output connector 20 including a first grounding pin connected to the ground circuit 13 and the microphone case 10, wherein the ground circuit 13 and the microphone case 10 are electrically connected at multiple points via conductive connecting means 40, which can be brought into surface contact, to prevent a ground loop current path caused by a stray capacitance between the ground circuit 13 and the microphone case 10.

3 Claims, 2 Drawing Sheets

CONDENSER MICROPHONE

RELATED APPLICATIONS

The present application is based on, and claims priority from, Japanese Application Number 2004-158574, filed May 19, 2004, the disclosure of which is hereby incorporated by reference herein in its entirety.

TECHNICAL FIELD

The present invention relates to a condenser microphone and more specifically to a technique for preventing noise caused by high-frequency electromagnetic wave noise generated from, for example, a cellular phone or the like.

BACKGROUND ART

A condenser microphone includes an impedance converter such as an FET (field-effect transistor) because a condenser microphone unit of the condenser microphone has quite a high impedance. In ordinary cases, a phantom power source is used in the condenser microphone, and the output of the microphone is outputted through a balanced shield cable of the microphone. FIG. 3 schematically shows the configuration of a microphone output module section used for a conventional condenser microphone.

A part indicated by a frame of a chain line with reference numeral 10 in FIG. 3 is a microphone case of the condenser microphone. The microphone case 10 also serves as a shield case and thus is made of a conductive metallic material such as brass. In the case of a handheld microphone, the microphone case 10 is used as a grip held by a hand of a person.

The microphone case 10 houses a circuit board 11 having a ground circuit 13 and an electronic circuit 12 which is connected to a condenser microphone unit MU and includes a lowcut filter circuit and an amplifier circuit (both are not shown). Further, an output connector 20 is provided on the microphone case 10.

In ordinary cases, the output connector 20 is a 3-pin output connector defined by EIAJ RC-5236 "a latch-lock round connector for an audio system." To be specific, the output connector 20 comprises a first pin for grounding, a second pin used as the hot side of a signal, and a third pin used as the cold side of a signal (Reference numerals 1, 2, and 3 of FIG. 3 denote the first pin, the second pin, and the third pin, respectively) and the output connector 20 is connected to a phantom power source (not shown) via a microphone cable (balanced shield cable) 30.

Of these three pins, the second pin and third pin for signals are connected to the predetermined terminals of the electronic circuit 12 and the first pin for grounding is connected via a lead wire 1*a* to the microphone case 10 and the ground circuit 13 of the electronic circuit 12 formed on the circuit board 11. The lead wire 1*a* is routed in the microphone case 10.

As described above, the microphone case 10 is a shield case made of, for example, a metallic material such as brass. For example, when a cellular phone is used near the microphone, strong electromagnetic waves may enter the microphone case 10 from the microphone cable 30 through the output connector 20, and the electromagnetic waves may be demodulated by the electronic circuit 12 and outputted as audio-frequency noise from the microphone. Incidentally, extremely strong electromagnetic waves are generated from a cellular phone (for example, in a range of about several cm to several tens cm, an electric field is several tens of thousands times as strong as an electric field generated by commercial radio waves).

Regarding a noise generating mechanism, in Document 1, Jim Brown of Audio Systems Group Inc. of the US and David Josephson of Josephson Engineering of the US point out the following problems: (1) the lead wire 1*a* of the first grounding pin routed in the microphone case 10 acts as an antenna and draws high-frequency current of external electromagnetic waves into the microphone case 10 and (2) a stray capacitance C between the microphone case 10 and the ground circuit 13 formed on the circuit board 11 forms a ground loop current path (ground loop) as indicated by an arrow of FIG. 3, and Jim Brown et al. propose the following solution to noise:

In Document 1, Jim Brown et al. propose a method of connecting the ground circuit 13 formed on the circuit board 11 to the microphone case 10 via a proper wire 1*b* as shown in FIG. 4, and directly connecting the first grounding pin included in the output connector 20 to the microphone case 10 without connecting the first pin to the ground circuit 13.

[Document 1] "Radio Frequency Susceptibility of Capacitor Microphones," cowritten by Jim Brown and David Josephson, Audio Engineering Society Convention Paper 5720 (page 12, FIG. 8).

According to the method of Document 1, the stray capacitance C between the ground circuit 13 and the microphone case 10 does not form a ground loop current path and the lead wire 1*a* routed from the first grounding pin to the ground circuit 13 is not present, that is, nothing acts as an antenna. Thus, it is possible to effectively prevent the entry of electromagnetic waves.

However, in the case of the method described in Document 1, the first grounding pin is directly connected to the microphone case 10. Thus, when a phantom power source is used, current passes through the microphone case 10. Therefore, when the first grounding pin is detached from the microphone case 10 for any reason, the microphone case 10 has a voltage of 30 V or higher in the case of a 48-V phantom power source, and thus a person may receive an electric shock with a touch of a hand on the microphone case 10.

SUMMARY OF THE INVENTION

Therefore, it is an object of the present invention to secure the safety of the human body and prevent noise caused by electromagnetic waves.

In order to attain the object, the present invention provides a condenser microphone comprising a conductive microphone case including a circuit board having a ground circuit and an electronic circuit for a condenser microphone unit, and a 3-pin output connector which is mounted on the microphone case and connected to a microphone cable from an external device including a polarized power source, the output connector including a first grounding pin connected to the ground circuit and the microphone case, wherein the ground circuit and the microphone case are electrically connected at multiple points to prevent a ground loop current path caused by a stray capacitance between the ground circuit and the microphone case.

According to this configuration, the microphone case and the ground circuit formed on the circuit board are connected at a plurality of points (multiple points). Thus, even if electromagnetic waves enter the microphone case from the first grounding pin, a ground loop current path caused by a stray capacitance is not formed between the ground circuit and the microphone case, so that the occurrence of noise is prevented.

The connection between the ground circuit and the microphone case can be readily obtained by disposing conductive connecting means between the ground circuit and the microphone case. The conductive connecting means is in surface contact with the ground circuit and the microphone case. Further, as to the conductive connecting means, connecting means comprising an elastic core and conductive fiber or fabric for covering the core is preferably used.

According to this configuration, even when the first grounding pin is detached from the microphone case, the potential of the microphone case does not increase and an electrical shock is unlikely to occur because the first grounding pin is connected to the ground circuit.

DETAILED DESCRIPTION

Figure 1:
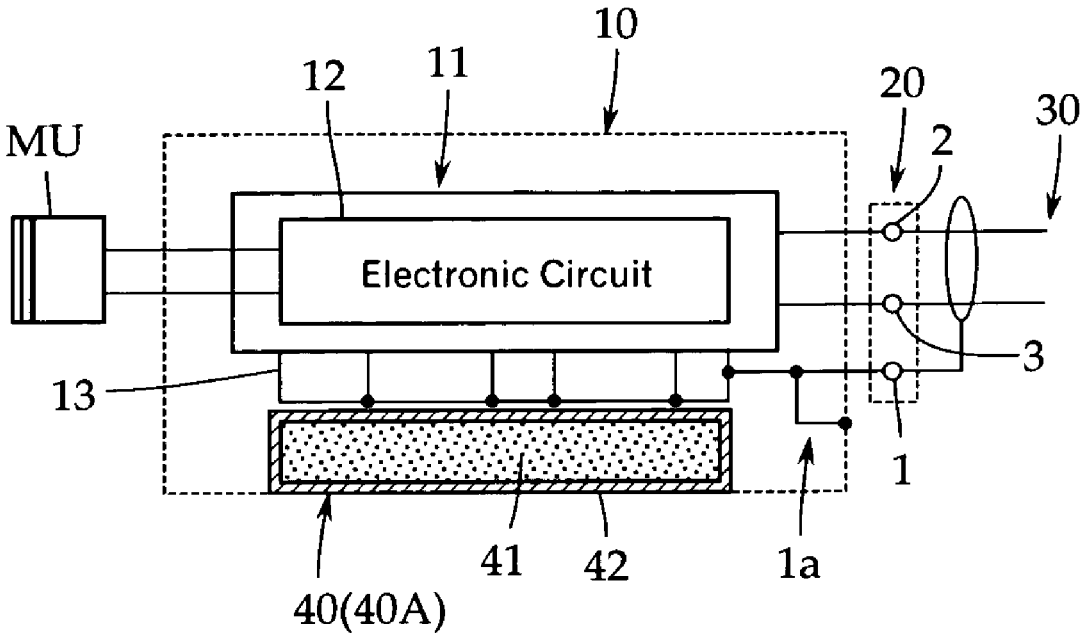
FIG. 1 is a schematic diagram showing the configuration of a microphone output module section which is a main part of a condenser microphone according to the present invention.
Figure 2:
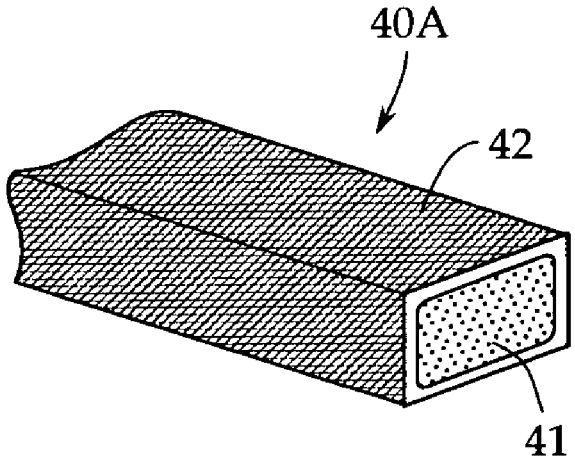
FIG. 2 is an enlarged perspective view showing a main part of an example of preferred conductive connecting means used for the present invention.
Figure 3:
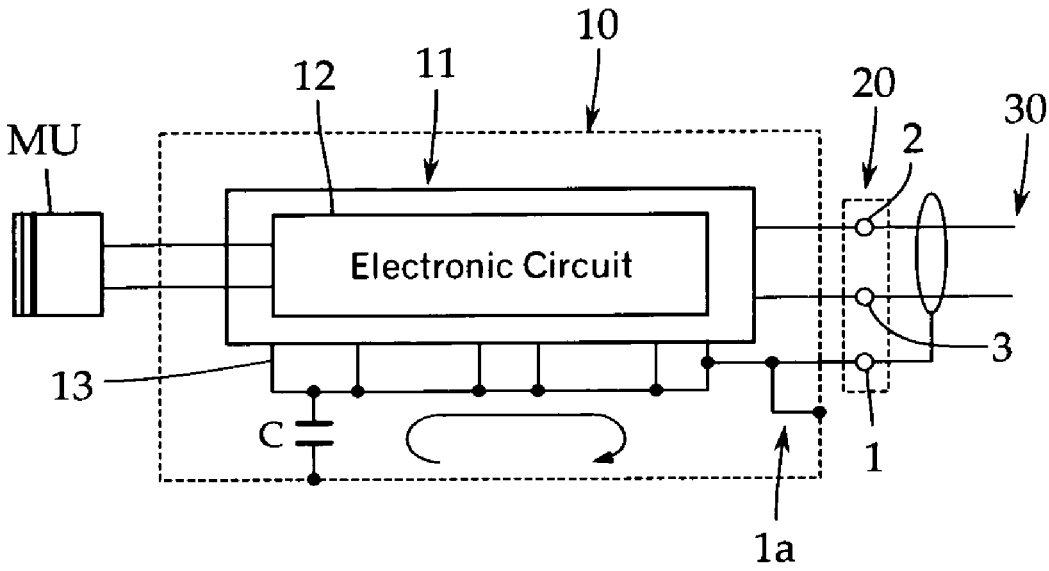
PRIOR ART FIG. 3
FIG. 3 is a schematic diagram showing the configuration of a microphone output module section of a conventional condenser microphone.
Figure 4:
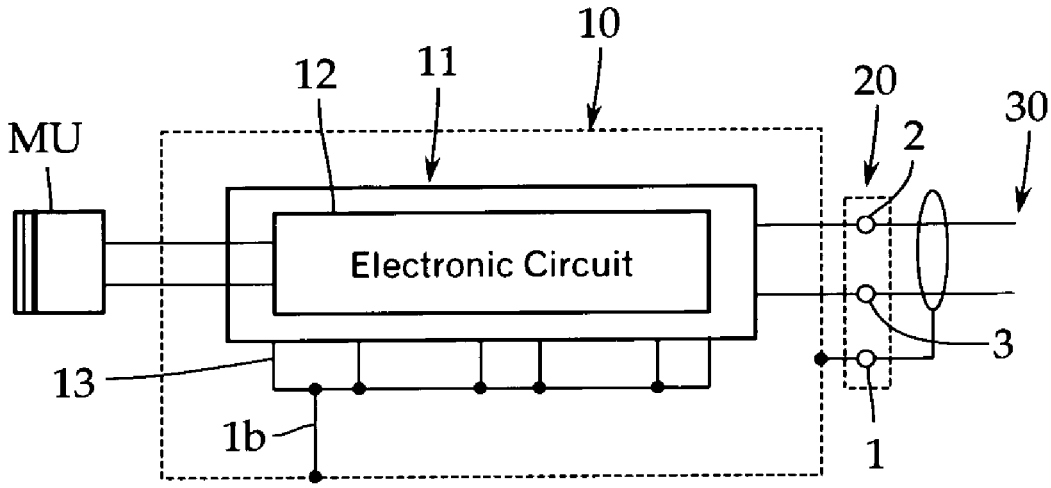
PRIOR ART FIG. 4
FIG. 4 is a schematic diagram showing the configuration of a microphone output module section of a condenser microphone according to Document 1.

Referring to FIGS. 1 and 2, an embodiment of the present invention will be described below. The present invention is not limited to this embodiment. FIG. 1 is a schematic diagram showing the configuration of a microphone output module section which is a main part of a condenser microphone of the present invention. FIG. 2 is an enlarged perspective view showing a main part of an example of preferred conductive connecting means used for the present invention. In the explanation of this embodiment, constituent elements particularly not to be changed from the conventional example of FIG. 3 are indicated by the same reference numerals.

Referring to FIG. 1, a microphone case 10 also serves as a shield case in the condenser microphone of the present invention, and thus the microphone case 10 is made of a conductive metallic material such as brass and a circuit board 11 is housed in the microphone case 10. Further, a 3-pin output connector 20 is mounted on the microphone case 10.

In the case of a handheld microphone, in order to prevent handling noise, a grip may have a double structure of an outer cylinder and an internal cylinder coaxially supported in the outer cylinder via a shock mount. In such a configuration, it is preferable to use the microphone case 10 as an internal cylinder.

The circuit board 11 comprises a ground circuit 13 and an electronic circuit 12 for a condenser microphone unit MU. In this example, the electronic circuit 12 and the ground circuit 13 are provided on the opposite surfaces of the circuit board 11 while being energized through a wire in a through hole, for example. To be specific, when the electronic circuit 12 is disposed on one surface of the circuit board 11, the ground circuit 13 is formed on the other surface of the opposite side. The electronic circuit 12 may include a lowcut filter circuit and a voice signal amplifier circuit as in the conventional example.

In the present invention, the condenser microphone unit MU may be a publicly known one regardless of electret type or non-electret type. Further, the condenser microphone unit MU may be connected to the electronic circuit 12 while being supported on one end of the microphone case 10. The present invention includes a configuration in which the condenser microphone unit MU is connected to the electronic circuit 12 via a dedicated microphone code (for example, a twin-core shield covered wire) as in a gooseneck microphone and a tie pin microphone.

The output connector 20 includes a first pin for grounding, a second pin used as the hot side of a signal, and a third pin used as the cold side of a signal. In the present invention, the first pin for grounding may be connected like the conventional example via a lead wire 1*a*, which is routed in the microphone case 10, to the microphone case 10 and the ground circuit 13 of the electronic circuit 12 formed on the circuit board 11. Moreover, the second pin and third pin for signals are connected to the predetermined terminals of the electronic circuit 12.

An important point of the present invention is that the ground circuit 13 and the microphone case 10 are electrically connected to each other at multiple points so as to prevent the occurrence of a ground loop current path caused by a stray capacitance between the microphone case 10 and the ground circuit 13 formed on the circuit board 11.

In order to obtain such an electrical connection at multiple points, conductive connecting means 40 which is in surface contact with the ground circuit 13 and the microphone case 10 is disposed between the ground circuit 13 and the microphone case 10. A conductive rubber, an anisotropic conductive adhesive, and so on can be used as the conductive connecting means 40. Conductive connecting means 40A of FIG. 3 achieves preferable assembling and a stable connection with a low resistance and thus is preferably used.

The conductive connecting means 40A is composed of conductive fiber (or conductive fabric) 42 covering the entire periphery of an elastic core 41. The core 41 is a column or a cylinder made of an elastic material such as a sponge and a rubber. As for the conductive fiber 42, conductive fiber obtained by performing nickel plating on nylon fiber having been coated with silver is suitable. Such conductive connecting means 40A having elasticity and conductivity is, for example, Soft Shield 5000 (trade name), TAIYO WIRE CLOTH CO., LTD. The conductive fiber 42 may be fabric woven of thin coil conductors.

By disposing the conductive connecting means 40 (preferably the elastic conductive connecting means 40A) between the circuit board 11 and the microphone case 10, the ground circuit 13 and the microphone case 10 are connected at multiple points. Thus, even when strong electromagnetic waves generated from a cellular phone or the like are applied to the microphone and enter the microphone case 10 from the first grounding pin through the microphone code 30, a ground loop current path caused by a stray capacitance between the ground circuit 13 and the microphone case 10 is not formed, so that the occurrence of noise can be effectively reduced.

The first grounding pin is connected to the ground circuit 13 and the microphone case 10 via the lead wire 1*a*. Thus, for example, even when a phantom power source is used as an external power source and one of the ground circuit 13 and the microphone case 10 (the ground circuit 13 or the microphone case 10) is detached due to an external impact, the voltage of the microphone case 10 does not increase and thus an electrical shock is unlikely to occur.

The invention claimed is:

1. A condenser microphone, comprising:

a conductive microphone case including a circuit board having a ground circuit and an electronic circuit for a condenser microphone unit, a 3-pin output connector which is mounted on the microphone case and adapted to be connected to a microphone cable from an external device including a polarized power source, the output connector including a first grounding pin connected to the ground circuit and the microphone case, and a conductive connecting device situated between the ground circuit and the microphone case, and comprising an elastic core and conductive fiber or fabric for covering the core, the conductive connecting device being in surface contact with the ground circuit and the microphone case so that the ground circuit and the microphone case are electrically connected in surface contact to prevent a ground loop current path caused by a stray capacitance between the ground circuit and the microphone case.

2. The condenser microphone according to claim 1, wherein the elastic core has a columnar or cylindrical shape made of an elastic material.

3. The condenser microphone according to claim 2, wherein the conductive fiber is a fabric woven of thin coil conductors.

* * * * *